US005499595A

United States Patent [19]

Pollen

[11] Patent Number: 5,499,595

[45] Date of Patent: Mar. 19, 1996

[54] PERSONAL WATER CRAFT WITH REAR MOUNTING MEANS

[76] Inventor: Randall P. Pollen, 1237 E. 900 N., Milford, Ind. 46542

[21] Appl. No.: 463,017

[22] Filed: Jun. 5, 1995

Related U.S. Application Data

[63] Continuation-in-part of Ser. No. 376,845, Jan. 23, 1995, abandoned.

[51] Int. Cl.[6] ..... B63B 17/00

[52] U.S. Cl. ..... 114/362; 114/270

[58] Field of Search ..... 114/343, 363, 114/362, 270; 182/196, 70, 88; 440/38

[56] References Cited

U.S. PATENT DOCUMENTS

| | | | |
|---|---|---|---|
| 277,672 | 5/1883 | Brendel | 182/196 |
| 2,286,936 | 6/1942 | Scrutton | 182/196 |
| 2,979,154 | 4/1961 | Bell | 182/196 |
| 5,074,236 | 12/1991 | Robertson | 114/362 |
| 5,152,244 | 10/1992 | Jarmillo, Jr. et al. | 114/362 |
| 5,427,049 | 6/1995 | Mardikian | 114/362 |
| 5,438,946 | 8/1995 | Kobayashi | 114/362 |

*Primary Examiner*—Edwin L. Swinehart
*Attorney, Agent, or Firm*—Leo H. McCormick, Jr.

[57] ABSTRACT

A personal water craft having a flexible strap with cross members attached thereto which is adapted to be selectively removed from a storage area to provide the means for an operator to egress from an aquatic environment onto a seat member.

12 Claims, 2 Drawing Sheets

PERSONAL WATER CRAFT WITH REAR MOUNTING MEANS

This application is a continuation-in-part of U.S. patent application 08/376,845 filed Jan. 23, 1995, now abandoned.

This invention relates to a personal water craft with rear mounting means which can be stored under a seat member and selectively extended by an operator to provide structure to egress from an aquatic environment.

BACKGROUND OF THE INVENTION

Personal water craft have been developed with a low center of gravity such that when located in an aquatic environment the seat member and controls are always in an upright position. In recent years advances have been made in the hulls of personal water craft to develop a unitary structure without drag such that high speed stability is achieved to permit the personal water craft to plane on essentially a small surface in an aquatic environment. Even though the steering mechanisms for such personal water craft allow for control and turns at times because of waves it is possible to dump an operator into the aquatic environment. The controls for personal water craft are such that when an operator is dumped into the aquatic environment the engine shuts down or stops. Thereafter, the operator swims to the personal water craft and grabs onto a hand hold and climbs onto the seat.

The seats on personal water craft are now sized to allow one, two or even three people to ride at one time. Unfortunately, if one person is dumped into the aquatic environment the remaining riders also will be dumped at substantially the same time. Now all riders people need to remount the personal water craft, however, if the weight of the riders approach the capacity of the personal water craft when both one or two riders attempt to mount the personal water craft from the same side, their combined weight may cause the personal water craft to rotate about the center of gravity giving the impression of tipping before they can get onto the seat. This can be solved by the riders mounting the personal water craft for opposite sides or from the rear of the personal water craft o Unfortunately when mounting from the rear care must be taken to avoid the steering nozzle. It has been suggested that a step could be attached to the rear of the personal water craft however such device would add drag to the unitary structure and holes must be drilled into the unitary structure to fix such step thereto. The use and attachment of such step has not received strong support since drag will reduce speed and by drilling into the unitary structure, stress points may be introduced to the unitary structure which could eventually cause a crack therein.

SUMMARY OF THE INVENTION

In the present invention, a unitary flexible nylon or polyester strap with a plurality of cross members sequentially attached to first and second sections extending from a midpoint is designed to be stored under a seat member and secured to a unitary housing of a personal water craft to provided a means for mounting a seat member from the rear of a personal water craft. The seat member of the personal water craft has a first edge hinged to the unitary housing and a second edge with a retractable member secured thereto. A clasp fixed to the unitary housing is engaged by the retractable member to join the seat member to the unitary housing. The midpoint of the strap is placed around the clasp and when the seat member is joined to the unitary housing, the strap member is also joined to the unitary structure. The first and second sections of the strap member have a sufficient length such that it will extend to a point below the bottom of the hull of the unitary structure. When a person in an aquatic environment desires to mount the personal water craft, the strap member is pulled into the aquatic environment and the person climbs on the cross members until safely on a ledge adjacent the rear of the personal water craft.

An object of this invention is to provide a personal water craft with rear mounting means that can be stored under a seat member and selectively extended to provide for egress from an aquatic environment.

A further object of this invention is to provide a personal water craft with a light weight mounting means that does not increase the drag when the personal water craft is propelled through an aquatic environment.

A still further object of this invention is to provide a personal water craft with rear mounting means that does not effect the steering nozzle.

An advantage of this invention resides in ability to store the flexible mounting means under a seat member when not in use and when needed to provide for deployment by a person into an aquatic environment when egress from the aquatic environment is desirable.

These objects and advantages will be apparent from reading this accompanying specification while viewing the drawings.

DETAILED DESCRIPTION OF THE INVENTION

Figure 1:
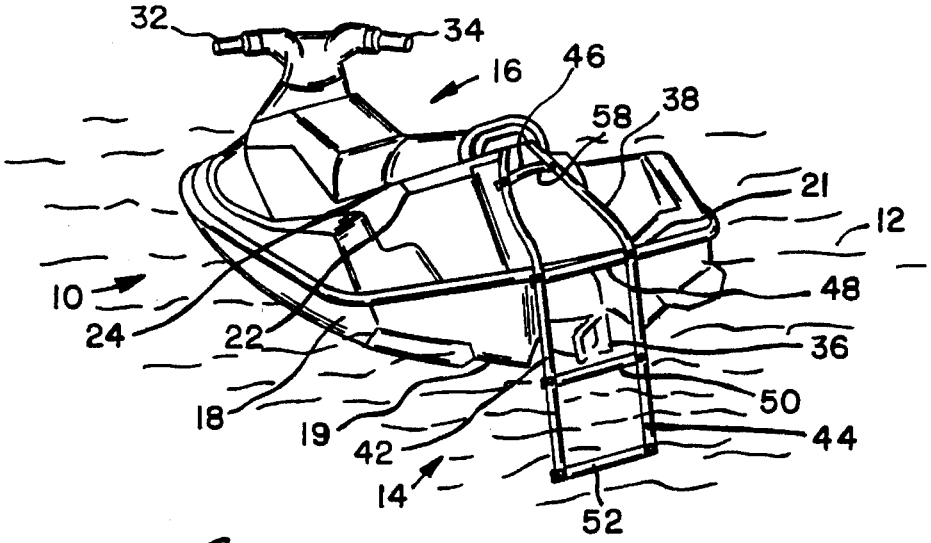
FIG. 1 is a schematic illustration of a personal water craft with mounting means made according to the present invention deployed into an aquatic environment.

The personal water craft 10 shown in FIG. 1 is located in an aquatic environment 12 has a mounting means 14 which will allow a person (not shown) to move from the water onto the seat member 16 without causing the personal water craft 10 to substantially rotate about an overturning moment. Thus, more than one person can climb out of the water or aquatic environment 12 while the personal water craft 10 remains in a substantially uniform horizontal plane.

Figure 2:
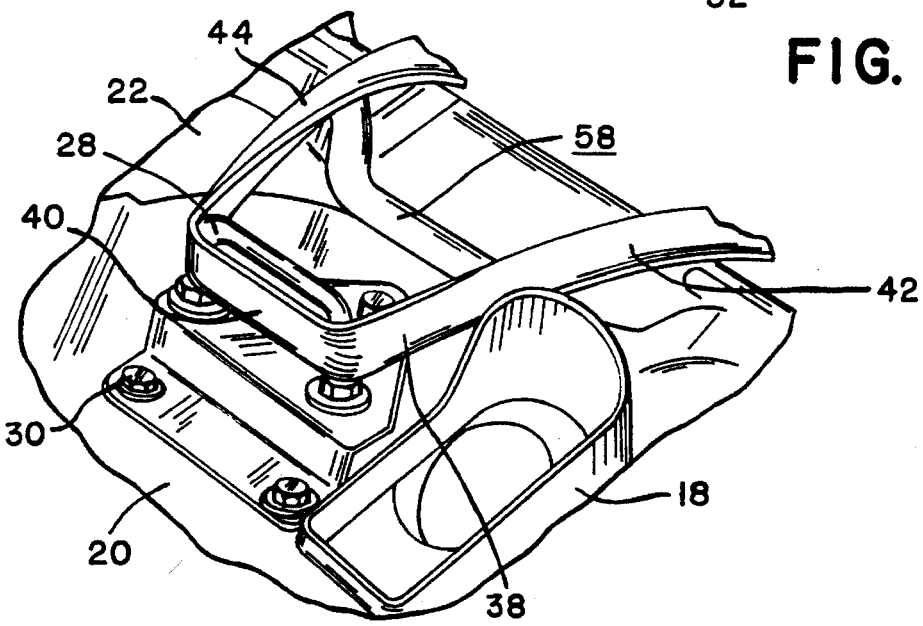
FIG. 2 is an enlarged view of the mounting means attached to a clasp attached to a unitary housing of the personal water craft of FIG. 1.
Figure 4:
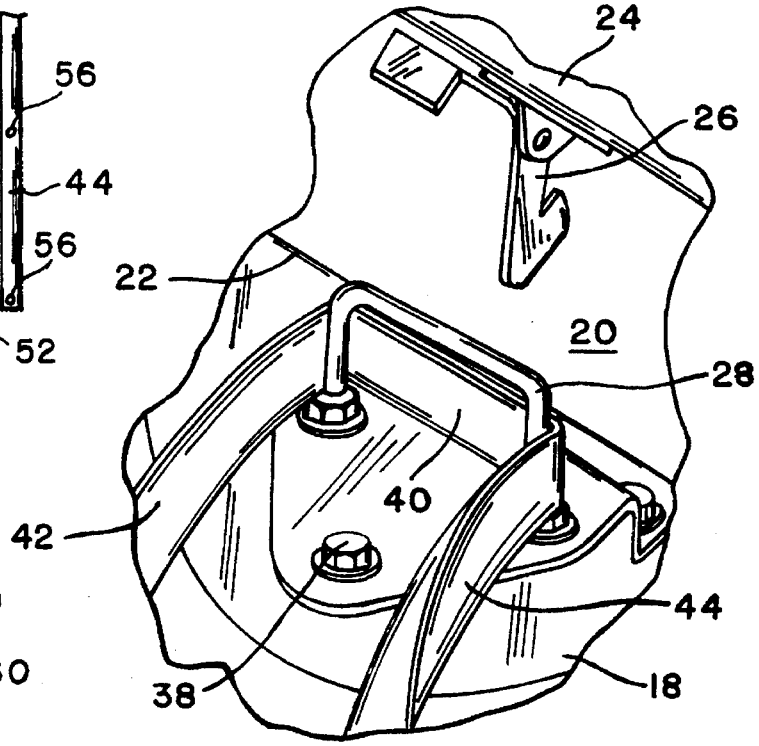
FIG. 4 is an enlarged view of portion of the seat member showing a locking structure which mates with the clasp to join the seat member to the unitary structure.

In more particular detail, the personal water craft 10 has a unitary housing 18 with a compartment 20 therein for retaining a source of power or engine (not shown). The compartment 20 has an opening 22 therein to provide access for servicing the engine. Seat member 16 has a first edge 23 hinged to housing 18 and a second edge 24 with a movable projection or spring loaded hook 26 thereon. A clasp 28, see FIGS. 2 and 4, which is fixed to housing 18 by a plurality of bolts 30, is designed to be engaged by the movable means or spring loaded hook 26 to join seat member 16 to housing 18 and close opening 22 as shown in FIG. 1. The source of power which is located in the compartment is adapted to propel the personal water craft 10 through the aquatic environment 12 in response to an in input from an operator applied to controls associated with hand bars 32 and 34. The operator when seated on the seat member 16 is connected to the controls by a lanyard (not shown) such that when an operator is off the seat, the power source is shut down. In addition, the hand bars 32 and 34 are connected to a jet nozzle 36 such that when an operator is not seated the hand bars 32 and 34 are turned to make the personal water craft 10 travel in a circle at a very slow speed. As with all riders of a personal water craft 10 no matter how good one is at some time, a person will be dumped into the water. When this happens it is necessary to again climb onto the seat member 16 without being concerned about the overturning moment of the personal water craft. The mounting means 14 allows a person to climb from the water onto the personal water craft 10 without substantially causing the personal water craft 10 to roll or turn in a manner which would give an impression of tipping.

Figure 5:
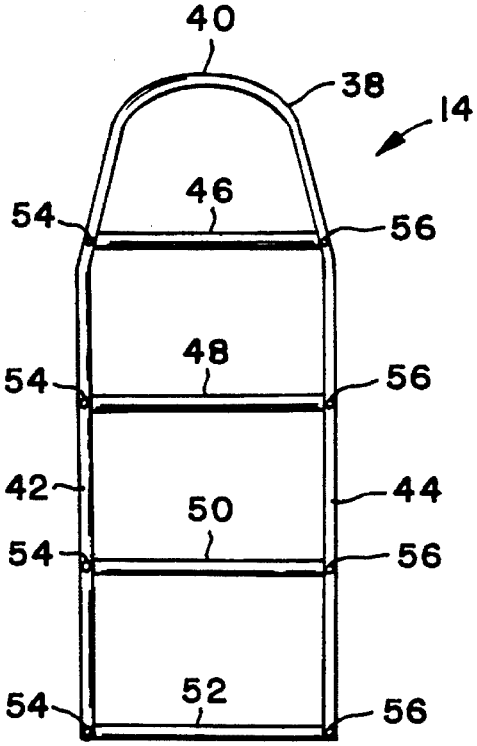
FIG. 5 is a view of the mounting means for the personal water craft of FIG. 1.
Figure 6:
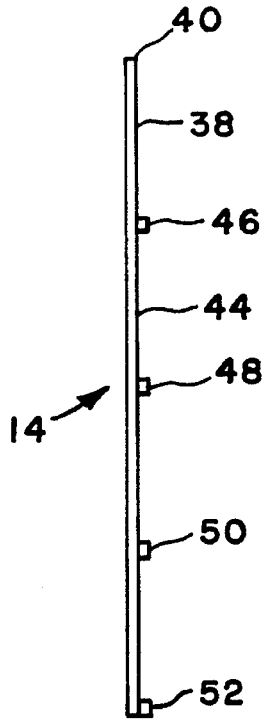
FIG. 6 is a side view of the mounting means of FIG. 5.

The mounting means 14 as best seen in FIGS. 5 and 6 consists of a flexible nylon strap 38 having a midpoint 40 with a first section 42 and a second section 44 extending therefrom. A plurality of cross members 46, 48, 50 and 52 are sequentially fixed to the first section 42 and second section 44 of strap 38. Each cross member 46, 48, 50, and 52 has a first end 54 fixed to the first section 44 and a second end 56 fixed to the second section 44. Cross member 46 is the top cross member and is designed to be located in a groove 58 in the unitary housing 18 to help maintain the first section 42 and second section 44 in parallel vertical planes when the mounting means 14 is extended into the aquatic environment or water 12 as shown in FIG. 1. In order to assure that the mounting means 14 is long enough for a person to climb onto the seat member 16 from the water, the length of the first section 42 and second section 44 is such that the bottom cross member 52 will be located in a position lower than the bottom 19 of the unitary housing 18 when the mounting means 14 is extended. The mounting means 14 has a plurality of intermediate cross members 48 and 50, however, it is desirable that at least one intermediate cross member 48 be located in the aquatic environment or water 12 between top cross member 46 and bottom cross member 52 to assure that a person has an easy egress from the aquatic environment or water 12 onto the seat member 16.

Figure 3:
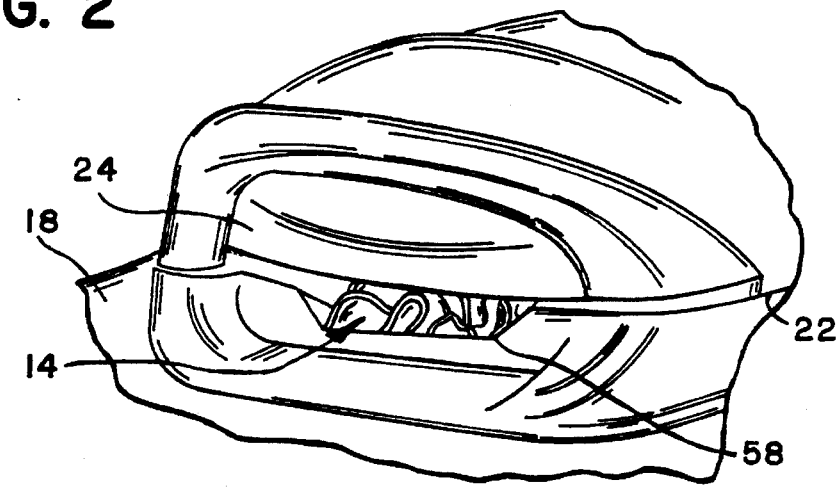
FIG. 3 is an enlarged view of the seat member joined to unitary housing of FIG. 1 with the mounting means stored in a space formed therebetween.

In order to prevent the mounting means 14 from causing a hazard or interfere with the turning controls for nozzle 36, a storage area 58, see FIG. 3, is formed between the seat member 16 and the unitary housing 18. The midpoint 40 of strap 38 is placed over clasp 28 and spring loaded hook brought into engagement with clasp 28 to close opening 22. Thereafter, mounting means 14, because of its lightweight weight construction of a nylon or polyester material, is stuffed into storage area 58 and out of the way of the riders until needed for egress from the water.

The mounting means 14 does not detract from the personal water craft 10 since it is hidden from view until needed and even when extended into the water can be of the same or contrasting color as the personal water craft 10. From experience it been determined the orange may be a color that a person may best see when in the water 12.

When a personal water craft 10 is manufactured a first edge of a seat member 16 is hinged to molded structure and a spring loaded hook 26 attached to a second edge to form a unitary structure 18. The area where the clasp 28 is bolted to the unitary structure or housing 18 is reinforced and can with stand any forces that are applied through the mounting means 14 as a person climbs from the water onto the seat member 16.

In operation, a person would swim to the personal water craft 10 and reach up and pull the mounting means 14 from the storage area 58 into the water or aquatic environment 12. The bottom cross member 52 would be in the water such that a person could easily climb from the bottom cross member 52 to the intermediate cross members 50 and 48 and onto the rail 21 at the rear of the personal water craft 10 for mounting seat member 16. Once on seat member 16, the mounting means 14 can easily be returned to storage area 58 where is it out of the way until again needed at some time in the future.

Figure 7:
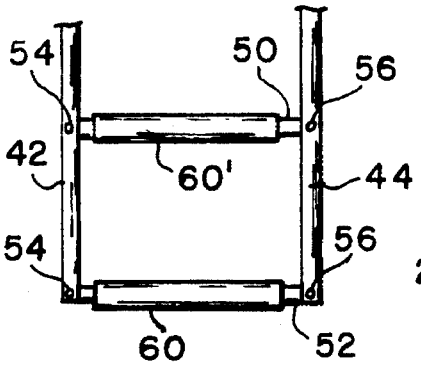
FIG. 7 is a view of a mounting means for a personal water craft of FIG. 1 wherein tubes surround and reinforce a bottom cross member and an intermediate cross member.

For some applications, the groove 58 in the unitary housing 18 may not be sufficient to maintain the first section 42 and the second section 44 in parallel and vertical planes when rapidly deployed into the aquatic environment. To assist in maintaining such a desired parallel and vertical relationship the bottom cross member 52 and intermediate cross member 50 are reinforced or stiffened by tube members 60, 60' as illustrated in FIG. 7. Tube members 60, 60' are made of a flexible plastic material which is impervious to water.

Figure 8:
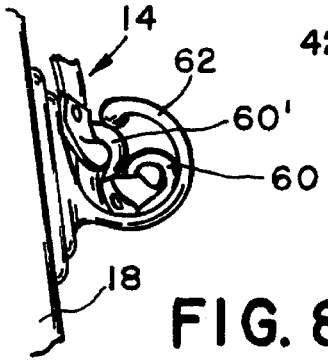
FIG. 8 is a side view of a means for retaining the reinforced bottom cross member and intermediate cross member on the unitary housing.

The functional operation of the mounting means 14 with the reinforced intermediate cross member 50 and bottom cross member 52 is as such: a person would swim to the personal water craft 10 and reach up, remove the intermediate cross member 50 and bottom cross member 52 from the first and second hangers 62 and thereafter pull the mounting means 14 from the storage area 58 into the water or aquatic environment 12. At least the bottom cross member 52 would be in the water and have a defined fixed width such that a person could easily climb from the bottom cross member 52 to the intermediate cross members 50 and 48 and onto the rail 21 at the rear of the personal water craft 10 for mounting seat member 16. The reinforcement or tube members 60, 60' would make it difficult to return the intermediate cross member 50 and bottom cross member 52 to storage area 58 and as a result attaching means such as the first and second hangers 62, (only one is shown in FIG. 8) are attached to the unitary housing 18 by suction cups or Velcro strips could be located on strips 42 and 44 and the unitary housing 18 to position and retain the intermediate cross member 50 and bottom cross member 52 adjacent storage area 58. Each of the first and second hangers 62 have a C shape for retaining the now reinforced intermediate cross member 50 and bottom cross member 52 while the remainder of the mounting means 14 is retained in storage area 58. Thereafter, once a person is on seat member 16 the top cross member 46, and intermediate cross member 48 of mounting means 14 are returned to storage area 58 and intermediate cross member 50 and bottom cross member 50 placed on the first and second hangers 62 until again needed at some time in the future. An advantage of locating at least the reinforced bottom member 52 external to the storage area 58 is the ease in locating and rapidly pulling the mounting means 14 into the water 12 when a person is in the water.

I claim:

1. In a personal water craft having a unitary housing with a compartment therein for retaining a source of power, said compartment having an opening therein, a seat member having a first edge hinged to said housing and a second edge with a movable projection thereon, a clasp fixed to said housing, said movable projection engaging said clasp to join said seat member to said housing and close said opening, said source of power being adapted to propel said personal water craft through an aquatic environment in response to an in input from an operator positioned on said seat member, the improvement comprising:

mounting means secured to said clasp and selectably extendible from said housing into said aquatic environment in response to an operator located in said aquatic environment, said mounting means providing structure for an operator to move from said aquatic environment onto said seat member.

2. In the personal water craft as recited in claim 1 wherein said mounting means includes:

a flexible strap having a midpoint with a first section and a second section extending therefrom, said midpoint engaging said clasp; and a plurality of cross members sequentially fixed to said first and second sections of said strap, each of said cross members having a first end fixed to said first section and a second end fixed to said second section.

3. In the personal water craft as recited in claim 2 wherein said plurality of cross members includes:

a top cross member located in a groove in said unitary housing to help maintain said first and second sections in parallel vertical planes when the mounting means extends into the aquatic environment.

4. In the personal water craft as recited in claim 3 wherein said plurality of cross members includes:

a bottom cross member located in said aquatic environment at a position lower than said unitary housing when the mounting means is extended; and an intermediate cross member located in said aquatic environment between said top and bottom cross members, said intermediate cross member allowing an operator easy egress from the aquatic environment onto said seat member.

5. In the personal water craft as recited in claim 2 wherein said housing includes:

a storage area formed between said seat member and unitary housing adjacent said clasp for retaining said strap and cross members.

6. In the personal water craft as recited in claim 1 wherein said housing includes:

a storage area formed between said seat member and unitary housing for retaining said mounting means.

7. In the personal water craft as recited in claim 2 wherein said plurality of cross members further includes:

a top cross member;

a bottom cross member located in said aquatic environment at a position lower than said unitary housing when the mounting means is extended; and an intermediate cross member located in said aquatic environment between said top and bottom cross members, said bottom cross member and intermediate cross member allowing an operator easy egress from the aquatic environment onto said seat member.

8. In the personal water craft as recited in claim 7 wherein said plurality of cross members further includes:

a reinforcing member which surrounds said bottom cross member to maintain said first and second sections in parallel vertical planes when the mounting means extends into the aquatic environment.

9. In the personal water craft as recited in claim 8 wherein said plurality of cross members further includes:

reinforcing members which surrounds said bottom cross member and said intermediate cross member to maintain said first and second sections in parallel vertical planes when the mounting means extends into the aquatic environment.

10. In the personal water craft as recited in claim 2 further including: attachment means fixed to said housing adjacent said clasp on said housing for retaining at least one cross member of said mounting means.

11. A method of manufacturing a personal watercraft having mounting means stored under a seat member located on a unitary structure, said mounting means being selectively extended to provide structure for egress from an aquatic environment onto a seat comprising the steps of:

attaching a first edge of said seat member to said unitary structure through a hinge:

securing a retractable member to a second edge of said seat member:

fixing a clasp to said housing;

locating a midpoint on a strap having a first section and a second section, said strap having a plurality of cross members fixed to said first and second sections;

securing said strap to said unitary housing by engaging said clasp with said midpoint;

moving said retractable member into engagement with said clasp to hold said strap between said seat member and unitary housing; and storing said strap and plurality of cross member in a space formed between said seat member and unitary housing, said strap and cross member being adapted to remain in said space until an operator grasp a cross member and pulls the strap into an aquatic environment to provide the structure to egress from the aquatic environment onto the seat member.

12. A method of manufacturing a personal water craft having storage area under a seat member of a unitary structure for retaining at least a portion of a mounting means, said mounting means being selectively extended to provide structure for egress from an aquatic environment onto a seat comprising the steps of:

attaching a first edge of said seat member to said unitary structure through a hinge;

securing a retractable member to a second edge of said seat member;

fixing a clasp to said housing;

locating a midpoint on a strap having a first section and a second section, said strap having a top cross member, first and second intermediate cross members and a bottom cross member fixed to said first and second sections, said plurality of cross members having a bottom cross member reinforced with a tube that extends from said first section to said second section;

securing said strap to said unitary housing by engaging said clasp with said midpoint;

moving said retractable member into engagement with said clasp to hold said strap between said seat member and unitary housing;

storing said strap and the top cross member and first intermediate cross member in a space formed between said seat member and unitary housing: and locating said second intermediate cross member and bottom cross member on attachment means located on said housing adjacent said clasp, said strap and cross member being adapted to remain in said space until an operator grasp the bottom cross member and pulls the strap into an aquatic environment to provide the structure to egress from the aquatic environment onto the seat member.

* * * * *